US008262038B1

(12) United States Patent
Hallet

(10) Patent No.: US 8,262,038 B1
(45) Date of Patent: Sep. 11, 2012

(54) ADJUSTABLE MACHINE STABILIZER WITH FOOT CONTROL ROTOR

(76) Inventor: Larry G. Hallet, Bangor, PA (US)

( * ) Notice: Subject to any disclaimer, the term of this patent is extended or adjusted under 35 U.S.C. 154(b) by 599 days.

(21) Appl. No.: 12/185,343

(22) Filed: Aug. 4, 2008

Related U.S. Application Data

(60) Provisional application No. 60/955,203, filed on Aug. 10, 2007.

(51) Int. Cl.
*A47B 91/02* (2006.01)

(52) U.S. Cl. ..... 248/188.4; 248/188.2; 248/188.8; 248/677

(58) Field of Classification Search ..... 248/188.4, 248/188.2, 188.9, 649, 650, 188.8, 677, 615, 248/616, 188.7; 16/42 R, 901, 430, 432, 16/433, 441; 182/108, 109, 111; 411/435; D8/398, 397
See application file for complete search history.

(56) References Cited

U.S. PATENT DOCUMENTS

| | | | | | |
|---|---|---|---|---|---|
| 144,028 | A | * | 10/1873 | Hill | 248/188.4 |
| 331,297 | A | * | 12/1885 | Hall | 248/188.4 |
| 563,241 | A | * | 6/1896 | Wood | 248/188.4 |
| 638,997 | A | * | 12/1899 | Stock | 248/188.9 |
| 842,641 | A | * | 1/1907 | Fernau | 248/188.4 |
| 1,125,668 | A | * | 1/1915 | Deming | 248/188.4 |
| 1,451,999 | A | * | 4/1923 | Perry | 248/188.4 |
| 2,024,728 | A | * | 12/1935 | Galson | 248/616 |
| 2,177,677 | A | * | 10/1939 | Staben | 182/21 |
| D187,818 | S | * | 5/1960 | Grimm | D8/397 |
| 2,938,759 | A | * | 5/1960 | Rudow et al. | 248/188 |
| D222,528 | S | * | 11/1971 | Schwartz | D8/398 |
| 3,970,273 | A | * | 7/1976 | Tanner | 248/615 |
| 4,441,758 | A | * | 4/1984 | Fleischer et al. | 297/423.46 |
| D278,029 | S | * | 3/1985 | Suponitsky | D8/397 |
| D284,165 | S | * | 6/1986 | Brilando et al. | D8/397 |
| D302,109 | S | * | 7/1989 | Cayce et al. | D8/398 |
| 4,899,771 | A | * | 2/1990 | Wilkinson | 135/77 |
| D376,713 | S | * | 12/1996 | Kelso | D6/496 |
| 5,722,627 | A | * | 3/1998 | Hoshino | 248/405 |
| D435,652 | S | * | 12/2000 | Nazarifar et al. | D24/129 |
| 6,186,453 | B1 | | 2/2001 | Redbone | |
| 6,253,942 | B1 | * | 7/2001 | Elias | 215/305 |
| 6,520,459 | B2 | * | 2/2003 | Burr | 248/188.4 |
| D472,947 | S | * | 4/2003 | Wu | D21/694 |
| 6,634,608 | B2 | * | 10/2003 | Jacobowitz | 248/230.7 |
| 6,729,597 | B2 | | 5/2004 | Cholinski et al. | |
| 6,877,520 | B2 | * | 4/2005 | Morris | 135/77 |
| D504,809 | S | * | 5/2005 | Sato et al. | D8/382 |
| 6,910,666 | B2 | * | 6/2005 | Burr | 248/188.4 |
| D515,886 | S | * | 2/2006 | McAnally | D8/14 |
| D520,856 | S | * | 5/2006 | Osiecki et al. | D8/312 |
| D525,513 | S | * | 7/2006 | Anderson et al. | D8/307 |
| 7,178,768 | B2 | * | 2/2007 | Inoue | 248/188.4 |

(Continued)

OTHER PUBLICATIONS

Page from catalog of Furniture Guides and Levelers.

*Primary Examiner* — Terrell McKinnon
*Assistant Examiner* — Ingrid M Weinhold
(74) *Attorney, Agent, or Firm* — Charles A. Wilkinson; Clinton H. Wilkinson

(57) ABSTRACT

A stabilizer device for connecting to the bottom support surface of a machine or article of equipment for supporting such equipment on a floor surface having a foot-actuated rotor for adjusting the length of the stabilizer shank and thereby stabilizing and balancing such equipment.

14 Claims, 5 Drawing Sheets

U.S. PATENT DOCUMENTS

D551,961 S * 10/2007 Huh ..... D8/397
D558,306 S * 12/2007 McCluskey et al. ..... D23/264
D582,763 S * 12/2008 Riedel et al. ..... D8/397
7,568,874 B2 * 8/2009 Riedel et al. ..... 411/435
D600,108 S * 9/2009 Swan ..... D8/397
D600,546 S * 9/2009 Scilingo et al. ..... D8/397
7,600,727 B2 * 10/2009 Chien et al. ..... 248/188.4
D609,999 S * 2/2010 Andersson ..... D8/399
7,762,506 B2 * 7/2010 Beshore ..... 248/188.9
2001/0019096 A1 * 9/2001 Andreoli et al. ..... 248/188.8

* cited by examiner

Fig. 1
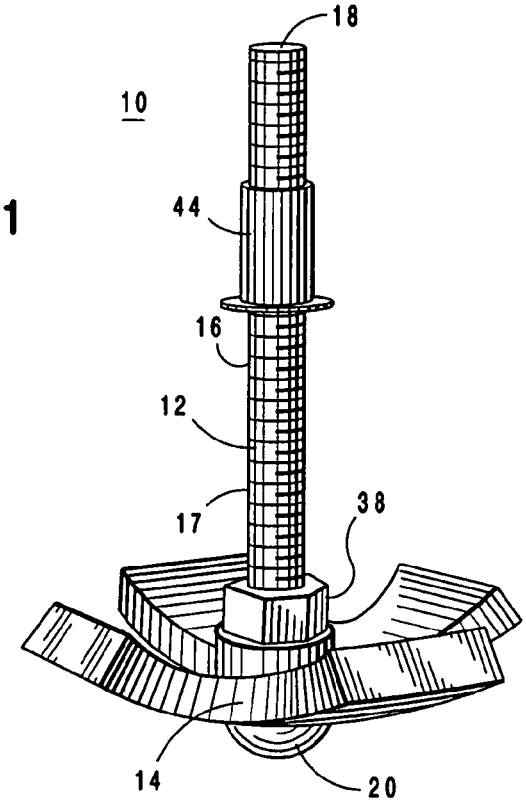
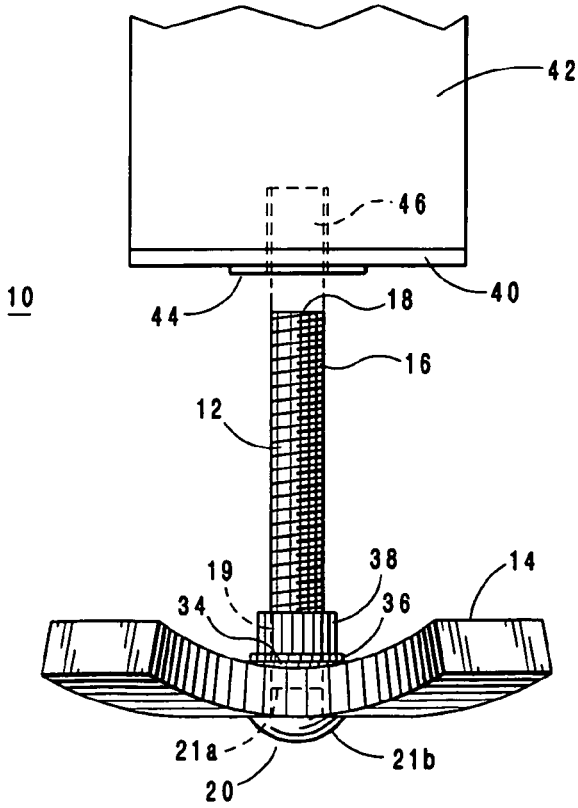
Fig. 2

Fig. 3
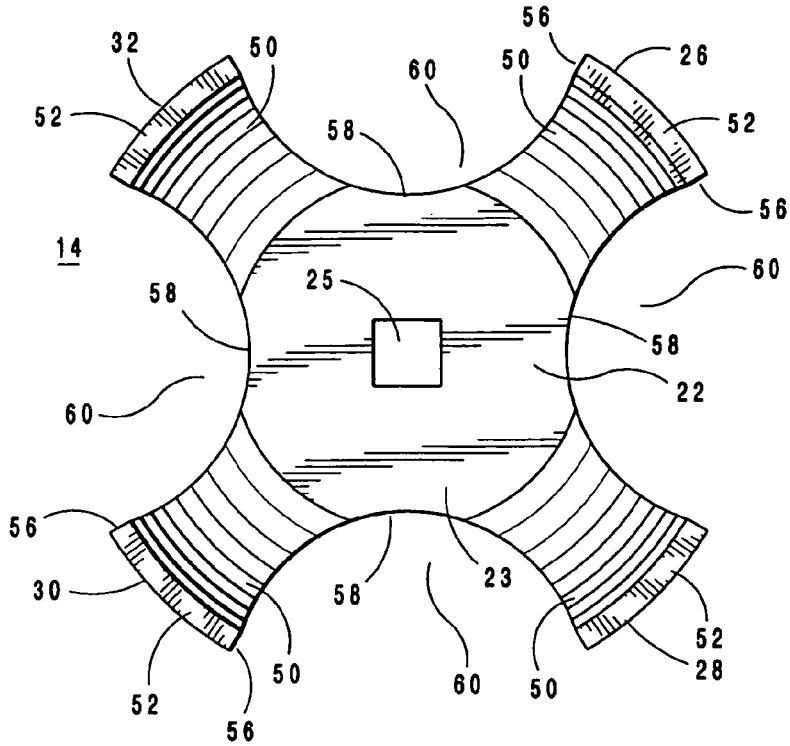
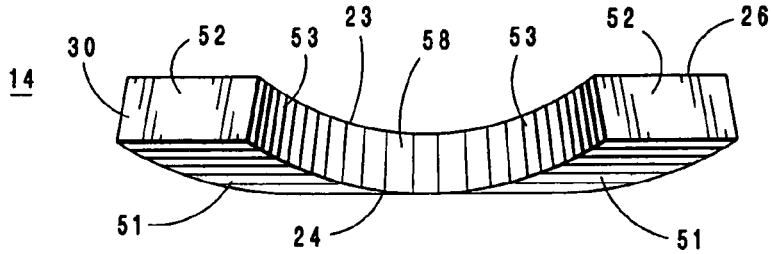
Fig. 4
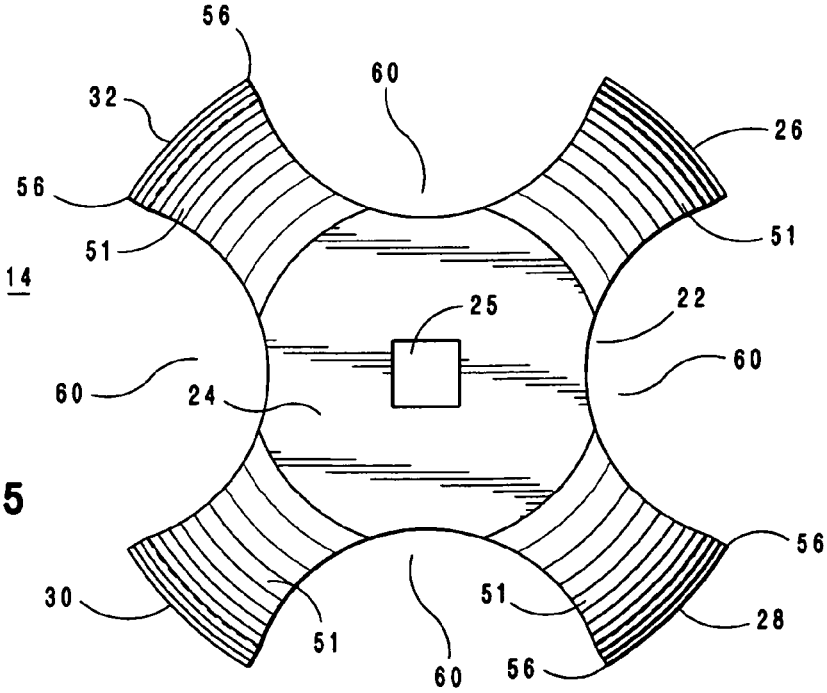
Fig. 5

ADJUSTABLE MACHINE STABILIZER WITH FOOT CONTROL ROTOR

CROSS REFERENCE TO RELATION APPLICATION

This application claims the benefit of provisional application 60/955,203 filed on Aug. 10, 2007, the disclosure of which is hereby incorporated by reference in its entirety.

BACKGROUND OF THE INVENTION

The present invention is directed to stabilizing devices of a type that are attached to the lower support structure of a machine or article of equipment and support such machine or article of equipment on an underlying floor-like support surface to prevent wobbling or tipping during use.

PRELIMINARY DISCUSSION

Machines, work tables, and other equipment having a rigid support structure are typically designed to rest on an underlying flat, horizontal support surface, such as a factory or shop floor. Due to various factors such as poor building construction or the ground shifting and settling over time, however, many underlying floor-like support surfaces are uneven and/or non-level or flat. In addition, many shop floors are intentionally constructed to be at a slight angle to accommodate liquid drainage. In such instances, machines and equipment resting on these support surfaces are often wobbly and unstable. A related problem occurs where the lower support plane of the machine or article of equipment framework is uneven or imperfectly balanced, either due to a manufacturing flaw, wear or structural damage, or even varying atmospheric conditions which can cause expansion and contraction of the structural support members, which conditions would also cause the entire machine to be inadequately supported even on a level floor surface. Not only can wobbly or poorly balanced machinery and equipment be dangerous to the operator and others in close proximity while the machinery is in use, but such condition can also cause damage or excessive wear to the machinery itself. When a machine or article of equipment, especially heavy-duty machinery and equipment, becomes unstable or wobbly, typically an operator will first attempt to stabilize the equipment either by using a makeshift stabilizer, such as a wedge-shaped shim or the like, or by adjusting one or more of the legs using a heavy-duty wrench or other tools. If these solutions fail, the owner will usually have to employ a professional to make the proper repairs, which in a manufacturing environment can create a significant stoppage in production and cost the user both time and money.

There is need therefore for a device that enables operators to quickly and easily adjust and stabilize machinery and equipment if it becomes unstable or wobbly without having to resort to makeshift solutions that may only be temporarily effective and which are frequently tenuous at best and therefore the machinery is still dangerous to the user, or having to pay a professional to install replacement legs or make other costly repairs. Such a stabilizer device would also be a convenience for anybody who uses equipment in an industry setting, including small and large fabrication shops, on assembly floors, in the home, hobby shops, offices, hospitals and wherever mobile equipment is too rigid to conform to an uneven floor. Recognizing this need, the present inventor has developed such a stabilizer device, where in one arrangement one of the devices can be placed on a given corner or leg of a piece of mobile equipment and then used to properly balance such equipment. In another arrangement, two stabilizers, placed on adjacent corners, can be used with equipment having wheels to keep such equipment and wheels stationary, while in yet another arrangement a plurality of stabilizers can be positioned on the underside of each corner or supported area and used to adjustably stabilize such equipment from any side. The stabilizer device is foot actuated and can be used to balance unstable equipment in a matter of seconds, saving the user time and money not only in attempting to diagnose the problem, but also then possibly having to pay to have the equipment repaired. The present inventor's stabilizer device is also convenient and compatible with nearly every type of machinery or mobile work table and is exceptionally sturdy and durable for its weight and manufacturing cost, and further has a long life and is shock resistant and suitable for rough use.

Several leveler devices are known in the prior art. However, as far as the present inventor is aware, none of such foot-actuated devices is sufficiently sturdy to be capable of being used to balance or stabilize heavy machinery or industrial equipment. For example, U.S. Pat. No. 6,186,453 issued to L. Redbone on Feb. 13, 2001, entitled "Foot Adjustable Levelers", discloses a leveler device for use on the legs of relatively light objects such as restaurant tables. The Redbone device consists of a threaded bolt that extends upwardly into a threaded aperture in the bottom of the table leg; in one embodiment, the bolt flange is encased in a hard rubber insert covered by a thin metal jacket which engages with the floor surface, and a soft rubber foot adjustment disc is secured extending radially outwardly from the bolt. Thus, the Redbone device is primarily a leveler device for placing the entirety of a table surface on the same horizontal plane, with the disc being engaged by the sole edge of the user's shoe to rotate the bolt. Such device is not designed to be used with industrial machinery or heavy-duty equipment to stabilize and therefore maintain the equilibrium of such machinery or equipment over long use periods. In particular, the soft rubber disc of the Redbone device would not generate a sufficient torque value into the vertical threaded shaft to enable the shaft to be rotated using only manual foot pressure if used to level heavy machinery or equipment. In addition to weight, other normal use factors would further reduce the effectiveness of the Redbone device, including the presence of a carpet, dirt and other grit under the foot of such leveler, buildup of dirt in the threads of the vertical threaded shaft, and lack of lubrication. Other factors, such as the type and material of the user's shoe soles, and the presence of a shoe polish or water repellant containing a wax, silicone, or oil, would further reduce the effectiveness of the Redbone device. The present inventor's stabilizer device, on the other hand, does not suffer from such drawbacks and is capable of being used to quickly and easily stabilize industrial machinery or articles of equipment as well as other items solely through the use of foot pressure on the outwardly extending blades of the device.

OBJECTS OF THE INVENTION

It is an object of the present invention, therefore, to provide a foot-actuated stabilizer device that can be used to stabilize wobbly equipment and machines, and in particular both heavy and light duty equipment and machines.

It is a further object of the present invention to provide a stabilizer device having a foot rotor assembly to facilitate manual adjustment and rotation of said stabilizer device using one's foot or shoe sole.

It is a still further object of the invention to provide an equipment stabilizer device actuated by a foot rotor assembly having a plurality of spaced apart individual rotor blades or rotors extending outwardly from the hub section of the rotor assembly at an acute angle to the plane of the hub section, said rotor blades being spaced apart a sufficient distance to enable an operator to exert a pressure or force with his or her shoe sole against the side surface of the rotor blades.

It is a still further object of the present invention to provide a stabilizer device that can be adapted for use with a wide range of machinery devices and articles of equipment in either a male or female configuration.

It is a still further object of the present invention to provide a stabilizer device that is convenient to use and compatible with nearly every type of machinery or mobile work table, that is exceptionally sturdy and durable for its weight and manufacturing cost, and that has a long life and is shock resistant and suitable for rough use.

Additional objects, advantages and uses of the invention will become evident from reference to the description of the invention and the attached drawing figures.

BRIEF SUMMARY OF THE INVENTION

The present invention is directed to a foot-actuated stabilizer device capable of being used to stabilize and balance both heavy-duly and light-duty machinery and equipment. The device includes a threaded shank having a preferably rounded floor engaging head section, and a foot rotor rigidly connected to the shank adjacent the head section and having a plurality of individual rotor blades rotors extending outwardly at an acute angle from the rotor hub. In use, the steel shank of at least one stabilizer device will be threadably connected near a corner or support area of the bottom support structure of a machine or article of equipment, and the side surface of one of the rotor blades is then repeatedly forcibly contacted by the front sole of a user's shoe to turn the rotor and shank in either a clockwise or counterclockwise direction, thereby adjusting the effective height of the device to alleviate a wobble and stabilize the machine on an underlying floor surface. In a preferred embodiment, the foot rotor is formed of polypropylene with four spaced apart rotor blades with the hub section rigidly secured to the stabilizer shank. The present stabilizer device may also be offered in a kit form containing both male and female threaded shanks for added user convenience in attaching the device to different already existing support structure arrangements.

BRIEF DESCRIPTION OF THE DRAWINGS

FIG. 1 is a perspective view of the stabilizer device of the present invention.

FIG. 2 is an isometric view of the stabilizer device from the side showing one manner of attachment to a bottom support surface of a machinery article.

FIG. 3 is a top plan view of the foot rotor of the present invention.

FIG. 4 is a side view of the foot rotor.

FIG. 5 is a bottom plan view of the foot rotor.

DESCRIPTION OF THE PREFERRED EMBODIMENTS

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention.

Leveling adjustments incorporated into the bottom or lower portions of industrial as well as home machinery such as washing machines or home workshop equipment have been widely used for many years. Typically, such adjustments include a threaded bolt-type arrangement with a flat or curved lower end next to an angular configuration of the shaft which can be gripped, frequently with some difficulty, with an adjustable wrench to rotate the shaft and thereby alter the distance the shaft extends from the bottom of the leg. These arrangements while fairly basic mechanically are difficult to use to level a machinery platform or stand because a wrench has to be placed parallel to the support surface to grip and turn the rotatable shaft and the leg structure of the supporting stand frequently obscures the portion of the shaft upon which a wrench has to be secure or gripped. Frequently one cannot even bring their head close enough to the supporting surface to view the portion of the shaft to be gripped because the user's head cannot be brought level with the gripping portion of the shaft to see the requisite portion of the shaft which must be gripped with the jaws of the wrench. In addition, if the machinery is fairly heavy, it may be quite difficult to rotate the shaft of a conventional leveling device with a small wrench. The construction of the stabilizing device of the present invention, however, allows the user to stand or remain upright while easily adjusting a helical stabilizer on the leg of a machinery table or the like by contact with the sole of the shoe of the person wishing to stabilize the apparatus stand.

Figure 6:
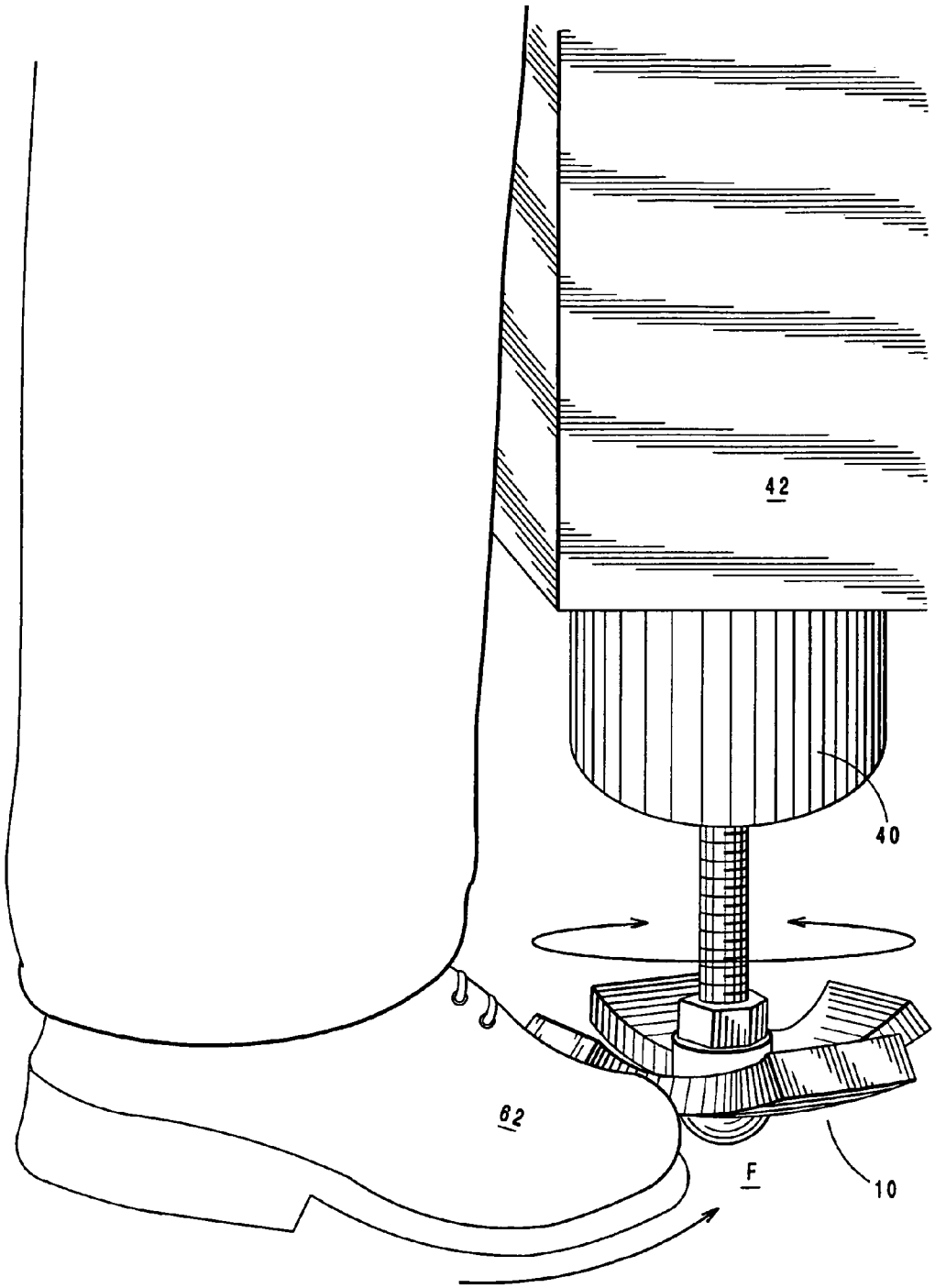
FIG. 6 is a perspective view demonstrating the manner of use of the stabilizer device.
Figure 7:
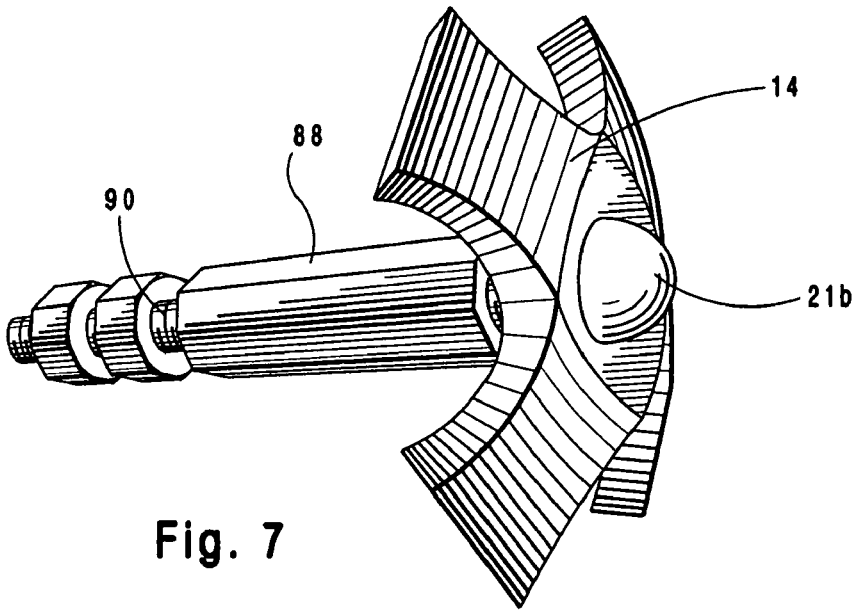
FIG. 7 is a perspective view of an alternative embodiment of the stabilizer device of the invention adapted for use with equipment having a female attachment configuration.
Figure 8:
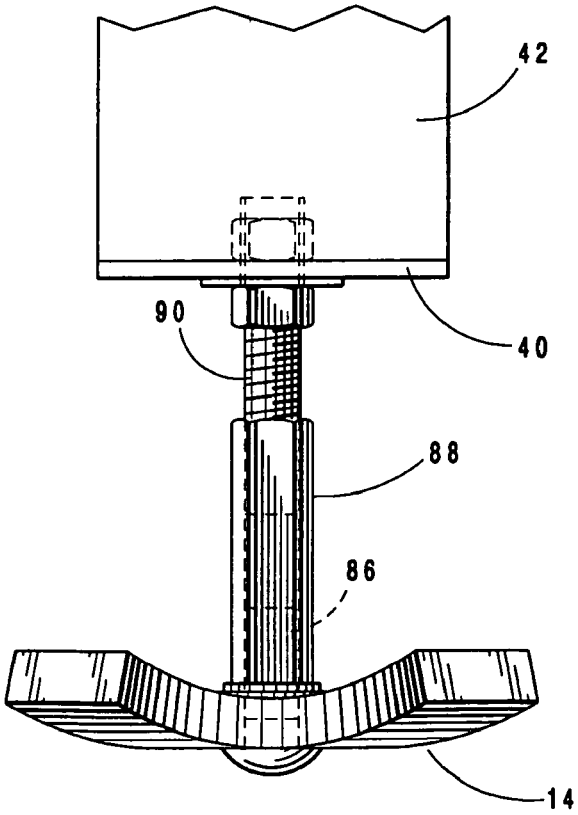
FIG. 8 is an isometric side view of the stabilizer device of FIG. 7 from the side showing the manner of attachment to a bottom support surface of a machinery article.
Figure 9:
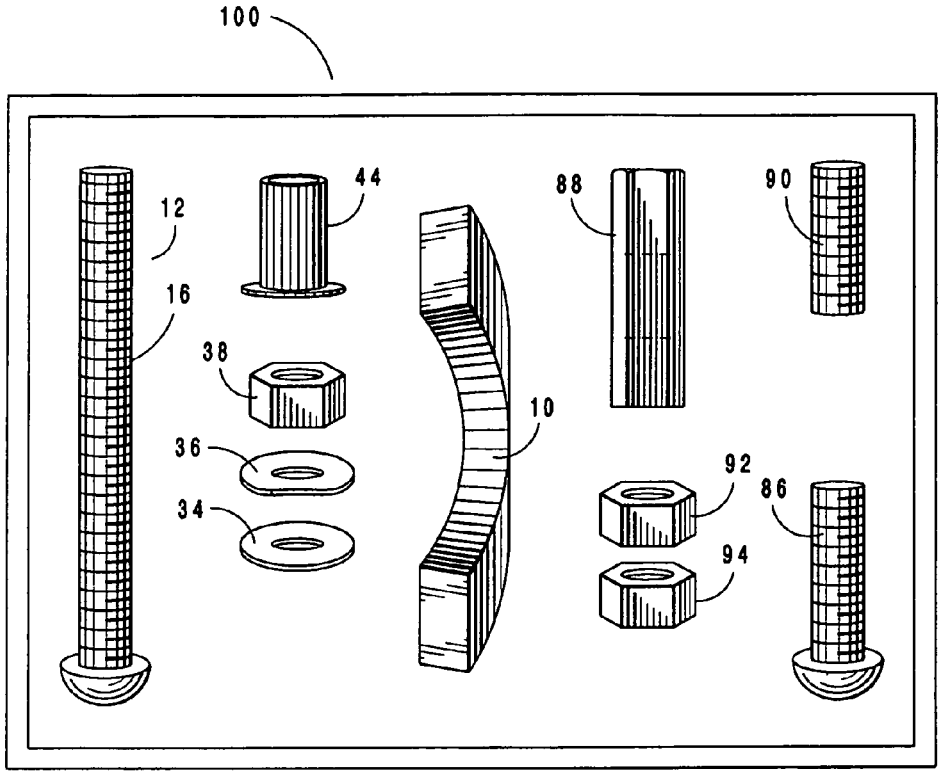
FIG. 9 is a perspective view showing a kit form for packaging the stabilizer device of the present invention.

FIGS. 1-6 illustrate a first embodiment of the stabilizer device of the present invention, FIGS. 7-8 illustrate an alternative attachment arrangement, and FIG. 9 illustrates a kit containing parts for enabling the stabilizer device to be attached in either a male or female configuration. Wherever possible, the same reference numerals are used in the drawings and the description of the alternative embodiment as in the previously described or first embodiment to refer to the same or like parts. Referring now to FIGS. 1-2, there is shown adjustable stabilizer device 10, which device is comprised generally of an elongated threaded bolt 12 and a foot rotor 14. Bolt 12 includes a shank section 16 having a first upper end 18 and second lower end 19, with a head section 20 at the lower end 19, and male threads 17 provided on substantially the entire outer surface of shank 16 from first end 18 to second end 19 abutting head section 20. In a preferred embodiment, rod 12 is a carriage bolt made of hardened steel having a base section 21*a* and an outer floor engaging member 21*b*, the shape of which member 21*b* is preferably smooth and rounded in order to minimize the amount of friction with an underlying floor surface during use of stabilizer device 10 as will be described in detail below.

While bolt 12 and foot rotor 14 may be integrally formed, in the presently described embodiment foot rotor 14 is manufactured as a separate part from bolt 12 and then is rigidly secured to such bolt. As shown in FIGS. 3-5, foot rotor 14 includes a central hub section 22 having a top surface 23 and a bottom surface 24, and a non-oval hole 25 extends longitudinally through the center of hub section 22. Preferably, hole 25 will be square to match the shape of the base section 21*a* of shank 16 of bolt 12, although this of course may be variable depending on such base shape, which may have other configurations. In addition, a plurality of rotor blades 26, 28, 30, and 32 extend outwardly from hub section 22 at an acute angle with respect to hub section 22, and preferably also with respect to first end 18 of shank 16. In the presently described embodiment, stabilizer device 10 is assembled by rigidly securing foot rotor 14 over base section 21*a* of shank 16 near second end 19 of bolt 12, with base section 21*a* fitting snugly in hole 25, and with top surface 23 of hub section 22 and rotor blades 26-32 preferably facing upwardly towards first end 18 of shank 16. As shown in FIG. 2, flat washer 34 is positioned on shank 16 adjacent top surface 23 of foot rotor 14, and a tooth star washer 36 is then positioned on top of flat washer 34 on shank 16. Nut 38, which may be a standard hex nut, is then threadably secured on shank 16 pressed tightly against tooth star washer 36, essentially locking foot rotor 14 rigidly on base section 21 of shank head 20 of bolt 16.

As is also shown in FIG. 2, the presently described stabilizer device 10 is designed to be secured to the bottom support surface 40 of a machine, machine support apparatus, or other article of equipment 42, which support surface 40 can be a bracket, equipment leg, or other available support surface depending upon the type of machinery or equipment involved. A flanged weld nut 44 having a threaded aperture 46 is preferably secured to the underside of bottom support surface 40, into which aperture 46 first end 18 of stabilizer shank 16 is threadably received, so that the shank 16 of bolt 12 may then be rotated in a clockwise or counterclockwise direction on threads 17 in threaded aperture 46 to adjust the height or length of shank 16 extending downwardly from support surface 40.

While foot rotor 14 may be made of any material having suitable strength and appropriate hardness characteristics, such as certain metals, woods, aluminum, or thermoplastic polymers, the present inventor has discovered through trial and error that a preferred material for use in forming foot rotor 14, due to its high tensile strength, stiffness, and surface hardness characteristics, is polypropylene. Polypropylene also provides or transfers sufficient torque values into the threaded shank, and furthermore is resistant to degradation due to chemical and electrical exposure as well as cold and heat degradation, and therefore such material can be used in the manufacture of foot rotor 14. Although the thickness of polyproylene foot rotor 14 may be varied, a thickness of ⅜ inches will transfer sufficient torque to rotate shank 16 in most circumstances, as is discussed in greater detail below, while shank 16 preferably has a thickness of either ⅜ inches or ½ inch, although this can also be varied depending upon the desired strength of the shaft for supporting and stabilizing certain articles of equipment and machinery. As shown in FIGS. 3 and 5, rotor blades 26, 28, 30, and 32, of which there may be a greater or lesser number, are spaced apart around hub section 22, and as indicated above are situated at an acute angle or low angle with respect to the hub section 22 and bolt shank 16 where the rotor is secured to bolt 12. It has been found through extensive experimentation that rotor blades 26, 28, 30, and 32 are preferably angled or curved upwardly at an acute or relatively low angle of preferably between fifteen and thirty degrees with respect to hub section 22, and most preferably between about eighteen and twenty two degrees. A relatively low angle has been found to be most efficient in transferring rotary motion from the sole of a shoe with rotation of shank or shaft 16. In addition, the angled rotor blades allow the operator to activate the device with the front edge of the shoe without having to slide the shoe or foot on the floor. Thus, as illustrated in FIG. 6, the operator will lower his or her toe and push forwardly, with the heel either being raised off of the ground or maintained parallel to or on the ground. More typically even, the foot may be inclined at an upward angle. If the rotors were not angled, although the device would still be operative, since the user could still engage the front edge of the foot between the rotor blades and force the shaft to rotate, the angled blade arrangement as shown has been found to better accommodate the rotational movement. Rotor blades 26, 28, 30, and 32 preferably are similarly shaped and have a top surface 50, a bottom surface 51, an outer or front surface 52 and side surfaces 53. In addition, as is best shown in FIGS. 3 and 5, sides 53 of each rotor may have a slightly concave shape, forming inwardly angled corners 56. In addition, the side surfaces 58 of hub section 22 between blades or rotors 26-32 also have a slightly concave shape, and together form rounded openings 60 between adjacent rotors.

As shown in FIGS. 2 and 6 and as has already been partially indicated, stabilizer 10 will typically be secured to the bottom support surface 40 of a corner of machine or other equipment 42 by threadably securing first end 18 of shank 16 in a flanged weld nut 44 secured to the underside of support surface 40, with the head section of the stabilizer in contact with the underlying floor surface and supporting a substantial portion of the weight of machine 42. Should the machine be wobbly or unbalanced, or should user desire to raise or lower the corner of machine 42 being supported by stabilizer 10, the user need simply engage the front sole or tip of his or her shoe 62 in one of the openings 60 between adjacent rotor blades, and apply a force against the appropriate side surface 58 of one of the rotor blades 26-32 to spin or turn shank 16 in either a clockwise or counterclockwise direction, and causing shank to move either further inwardly or outwardly on threaded flanged weld nut until equipment 42 is no longer wobbly or shaky. Note also that the side surfaces 58 of rotor blades 26-32 are slightly angled outwardly from top surface 23 to lower surface 24, and in addition that rotor blades 26-32 are flared outwardly towards their outer surfaces 56. Both the angled side surfaces and flared shape of the rotor blades further assists the user in quickly and easily gripping the front of his or her shoe sole on rotor 14. Since head section 21*b* of shank 16 has a rounded shape, only a small surface area of such head section will be in contact with the ground or shop floor surface, which minimizes the amount of friction between head section 21*b* and the floor surface, which makes rotor 26-32 and in turn shank 16 easier to turn with only a manual force applied to a side surface of one of the rotor blades. By rotating stabilizer device 10 via foot-actuated contact against the rotor blades, an operator can correct a wobble or unbalanced condition, or adjust the height of a piece of machinery or equipment in a few seconds without having to bend, or even stand up if the operator was in a seated position near the stabilizer device. The number of stabilizer devices of the present invention that can be used with a particular machine or piece of equipment being supported is variable, depending upon the circumstances and desired use of such devices. For example, a plurality of the present inventor's stabilizer devices can be used upon or to replace each of the conventional stabilizer legs or support members for a piece of machinery, or just two of the legs of a movable equipment-type table having a pair of wheels on the two other legs, or the stabilizer can be used on opposite pairs of legs, or single legs.

A key difference of the present inventor's stabilizer device from other adjustable support devices known to the present inventor and currently available in the marketplace is that none of the such other known foot-actuated devices are designed to stabilize heavy machinery or equipment. In experimental trials performed by the present inventor, a single stabilizer device 10 having a ⅜ inch diameter shank measuring approximately 3" in height and having ⅜ inch thick polypropylene rotors 3.875" in diameter across pairs of oppositely aligned rotors was secured to the bottom support surface of an equipment table having a total weight of 1,100 pounds. In such trial, the stabilizer device was able to support and adjustably stabilize one-half of the total weight of the table, or 550 pounds, with the rotor being easily rotated with application of only a foot-actuated force on the rotor blades. Thus, a stabilizer device having such listed properties and dimensions could be used as at least one of four floor supports used to evenly support a piece of equipment or machinery having a total weight of 2,000 pounds. The ⅜-inch polypropylene foot rotors used in such trial are able to withstand the same torque values as the vertically disposed threaded shank. More particularly, it was found that using ⅜ inch polypropylene foot rotors, a stabilizer having a ⅜ inch shaft has a torque value of 25 foot pounds, while a stabilizer having a one-half inch shaft has a torque value of 55 foot pounds. The foot rotors thus can withstand a considerable amount of wear and rough use, which they are likely to be subjected to in a workplace such as a machine shop. The stabilizer device also has good side thrust stability that allows versatility in mounting such device to mobile equipment such as the bottom center of a leg, the inside or outside of a straight leg, center leg, inside or outside of a compound angle leg, or on outrigger type supports and mobile bases. The acute angle of the individual blades or rotors with respect to the hub section of the foot rotor also greater improves the user's ability to engage the rotors with the front sole of his or her shoe and to turn the foot rotor in either direction. Due to its good torque value, the stabilizer device could also be used for light-duty, hold-down clamping on machinery.

FIGS. 7-8 illustrate an alternative embodiment of the stabilizing device of the present invention. Such embodiment is in general closely similar to the previously described embodiment except having four additional hardware pieces which together enable the device to be simply and easily adapted for use with a female connection arrangement rather than a male connection arrangement as in the previous embodiment. More particularly, the shaft 86 of the carriage bolt or fastener 12 is preferably shorter than shaft 16 in the previous embodiment, and in particular is sized to receive one end of a coupling member 88, preferably a hex coupling nut or sleeve nut having threaded openings or sleeves in opposite ends of a type well known to those skilled in the art, which coupling member will replace hex nut 38 in the previous embodiment. In addition, a threaded rod 90 is secured on one end in the upwardly facing sleeve of coupling member 88, while a pair of hex nuts 92 and 94 are secured to the opposite end of rod 90. Rod 90 is then fixedly secured in an aperture in bottom support surface 40 of a piece of equipment 42, and rotating of foot rotor 14 causes coupling member 88 to move on rod 90, thereby either increasing or decreasing the length of device 10 to stabilize the machine or equipment that is wobbly or unstable.

FIG. 9 illustrates a kit 100 for added user convenience containing all of the hardware required to enable stabilizer device 10 to be configured for use either with a male or female attachment configuration, both of which configurations has already been described in the above embodiments. Such parts include fastener 12, washer 34, spring washer 36, hex nut 38, carriage bolt 16, flanged receiver 44, bolt 86, coupling member 88, threaded rod 90 and hex nuts 92 and 94. Such kits may be provided in any desired dimensions, such as the shanks having either a ⅜ inch or ½ inch diameter threaded shanks, depending upon the desired strength or amount of weight to be supported by the stabilizer device. The kits it is believed would also be a valuable asset for do-it-yourselfers and make it easier for them to make improvements in the home. The stabilizer devices could also be offered in a variety of colors to accommodate user preferences, and additional sizes may be offered according to manufacturing desires.

As will be evident to those skilled in the art, the two attachment constructions shown in FIGS. 1 through 6 and again in FIGS. 7 and 8 are essentially equivalent in operation, but have some advantages and disadvantages peculiar to their own construction. The male rotational attachment tends to be less complicated and less costly to provide, while the female rotatable version shown in FIGS. 7 and 8 tends to be more structurally rigid because of its double thickness of metal along a principal length of the two threaded members during use. This version is also better able to maintain lubrication between the two members since there is usually a longer enclosed length. An even more important difference, however, is that the simpler version shown in FIGS. 1 through 6 requires for best operation and maximum adjustability, significant room internally of the leg support member upon which it is mounted in order for the threaded member to pass upwardly into the leg or support. The female coupling shown in FIGS. 7 and 8, on the other hand, does not require a hollow supporting member, but can be mounted upon a solid support member, since the coupling member extends normally downwardly from the outer surface of the leg or support, although it could be mounted upon an internal shelf within the structure of a support or leg. The adjustability is provided by the amount of overlap of the female threaded fitting over the male fitting. Normally, therefore, the construction of the supporting member or members of a unit of machinery will determine the type of stabilizer that will be usable with such machinery unit.

In the case of a kit for application of the two versions of supported levelers of the invention to various equipment, therefore, there will desirably be included in such kit several of the rotors of the invention plus several longer externally threaded members for attachment to the rotors and short coupling members for embedding in or attachment to a support member for machinery or equipment which member will be internally threaded for receipt of the threaded shaft frequently up into a leg or supporting member, while the coupling member remains stationary frequently as the result of separate fastenings through the flange of the coupling into the supporting member.

In the alternative arrangement, however, there will be a shorter externally threaded member arranged for securing to the exterior of a machinery support plus a supply of longer internally threaded members for threading over the shorter externally threaded member, thereby providing an adjustable length to the stabilizer. If the internally threaded member is itself made angular and particularly hexagonal on the surface, in case a sufficiently either forceful or accurate rotation cannot be accomplished by a rotation of the stabilizer with the foot, a more accurate adjustment can be made with a wrench slipped over and grasping the rotatable sleeve or internally threaded coupling unit. In both versions of the invention, the rotor is directly mounted upon a main shank, which in a female version of such shank will be internally threaded and preferably angular on the surface and may be rotatably threaded over an externally threaded member complementary to the internally threaded member and in the other principal embodiment, the main shank attached or secured to the rotor is externally threaded and will be adjustably screwed into a usually shorter internally threaded fitting secured to the leg or supporting surface of machinery support structures.

It has been found that $3/8^{th}$ inch thick polypropylene blades are sufficiently thick so as not to cut into the shoe or sole of one wearing shoes with thin soles to rotate the stabilizer device, although ¼ inch to ½ inch thicknesses will also be sufficiently thick and sufficiently strong or rigid to both apply sufficient side pressure to prevent breaking of the blades and not to cut into the shoe sole of the operator. A smooth metal blade will be similar. In the event a softer or less marring side contact surface were desired, the side of the plastic blades could be molded to increase in thickness toward their edge or to take an extended shape or be otherwise padded. In all cases, the side configuration of the rotor blades should have a surface texture and shape which will not cut into or damage the sides of a pair of shoes even if not so-called safety shoes.

While the present invention has been described at some length and with some particularly with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

The invention claimed is:

1. A stabilizer device for attachment to the support structure of a machine or piece of equipment comprising:

a) a threaded shank having a first end and a second end, the first end arranged to be rotatably adjustably connected to said support structure, and the second end including a head section adapted for engagement with a floor surface, and b) a foot-actuated rotor assembly rigidly connected to the shank near the head section of the shank, said rotor assembly including a hub section and a plurality of non-weight bearing blades each having top, bottom, side, and outer surfaces, said blades extending radially outwardly from the hub section of said rotor assembly at an acute angle with respect to the hub section and the first end of the shank of between about fifteen and thirty degrees, said bottom surfaces of said blades being wider than said top surfaces such that the side surfaces of each of said blades are outwardly angled from said top surface to said bottom surface, and the section of the side surfaces of said blades adjacent said outer surfaces is inwardly angled with respect to said outer surfaces, the side surfaces of said blades spaced apart to allow a portion of a user's foot or shoe to be engaged against a side surface of one of the blades to apply a manual turning force sufficient to rotate the shank with the head section in contact with the floor surface and the stabilizer bearing at least a portion of the weight of the machine or piece of equipment, to adjust the length of the shank extending from said support structure.

2. The stabilizer device as claimed in claim 1 in which said foot rotor assembly is comprised of polypropylene.

3. The stabilizer device of claim 1 in which the rotor blades flare outwardly towards their outer surfaces such that the blades are wider at their outer surfaces than midsection, and the side surfaces of the blades have a slightly concave shape extending from the hub section to the outer surfaces.

4. The stabilizer device of claim 2 in which the foot rotor assembly has a thickness of between one-quarter and one-half inch.

5. The stabilizer device of claim 2 in which the foot rotor assembly has a thickness of three-eighths of an inch.

6. The stabilizer device of claim 3 in which the rotor blades are angled between eighteen and twenty-two degrees with respect to the hub section of the rotor.

7. The stabilizer device of claim 6 in which the rotor blades are angled at twenty degrees with respect to the hub section of the rotor.

8. The stabilizer device of claim 1 additionally comprising a female threaded receiving device which is secured to said support surface and configured to threadably receive the first end of said threaded shank.

9. The stabilizer device of claim 1, additionally comprising a threaded coupling member configured to receive the first end of said threaded shank in a first end of said coupling member, a threaded bolt member having one end which is received in a second end of said coupling member, and a pair of securing members which are threadably secured to said threaded bolt member.

10. A machinery level stabilizing kit comprising:

a) individual sections of at least one foot-actuated stabilizing device inclusive of;

(1) a rotor having a central portion and a plurality of arms, each of the plurality of arms having a top surface and a bottom surface extending outwardly from said central portion, (2) a central threaded shank upon which the rotor is mounted, the shank having a floor engaging surface on one end, and (3) a threaded mounting for attachment to a leg of a machine mount, b) a containment means for temporary separation, display and storage of individualized portions of the at least one foot actuated stabilizing device, c) said individualized portions being ready for assembly into at least one foot actuated stabilizing device for mounting upon machinery supports for stabilizing heavy machinery;

d) wherein the rotor of said at least one stabilizing device has its outwardly extending arms deviated to one side at an acute angle of from fifteen to thirty degrees with respect to the central portion of said rotor; and e) wherein the bottom surface of each of said plurality of arms is wider than the top surface to provide outwardly angled side walls extending between said top and bottom surfaces.

11. A machinery level stabilizing kit in accordance with claim 10, additionally comprising a threaded coupling member configured to receive the first end of said central threaded shank in a first end of said coupling member, a threaded bolt member having one end which is received in a second end of said coupling member, and a pair of securing members which are threadably secured to said threaded bolt member.

12. A machinery level stabilizer kit in accordance with claim 10 wherein the at least one central threaded shank is externally threaded and the at least one threaded mounting upon which the threaded shank is mounted is internally threaded.

13. A machinery level stabilizer kit in accordance with claim 12 in which said central threaded shank is a carriage bolt having a non-oval base section, the central portion of said rotor having a matching non-oval aperture to facilitate mounting said rotor to said central threaded shank.

14. A foot-actuated rotor adapted to be rigidly connected to a rotatably adjustable machine stabilizer device, comprising:

(a) a hub section; and (b) a plurality of non-weight bearing foot receiving blades extending outwardly from the hub section at an acute angle with respect to the hub section, (c) said blades having a midsection and an end section and top, bottom, side, and outer surfaces and being dimensioned to allow a portion of a user's foot or shoe to be repeatedly engaged against any of the side surfaces of the blades to apply a manual turning force sufficient to rotate and adjust the length of the stabilizer, (d) the blades having a gradually greater width from said midsection to said end section, forming an inward angle along said side surfaces with respect to the outer surfaces of the blades;

(e) the bottom surfaces of said blades having a greater width than the top surfaces such that the side surfaces of each of the blades are outwardly angled from said top surface to said bottom surface.

* * * * *